United States Patent [19]

Funakawa et al.

[11] Patent Number: 4,743,169

[45] Date of Patent: May 10, 1988

[54] DIAPHRAGM-TYPE VACUUM PUMP DEVICE

[75] Inventors: Jun Funakawa, Nagoya; Hiroaki Morioka, Okazaki, both of Japan

[73] Assignee: Aisin Seiki Kabushiki Kaisha, Kariya, Japan

[21] Appl. No.: 58,708

[22] Filed: Jun. 2, 1987

Related U.S. Application Data

[63] Continuation of Ser. No. 769,468, Aug. 26, 1985, abandoned.

[30] Foreign Application Priority Data

Aug. 25, 1984 [JP] Japan ..... 59-177131
Aug. 25, 1984 [JP] Japan ..... 59-177132

[51] Int. Cl.[4] ..... F04B 49/00; F04B 39/00; F04B 45/00

[52] U.S. Cl. ..... 417/306; 417/413; 417/557; 417/571

[58] Field of Search ..... 417/299, 306, 309, 413, 417/440, 470, 502, 557, 198 C, 417, 442, 566, 571

[56] References Cited

U.S. PATENT DOCUMENTS

| | | | |
|---|---|---|---|
| 2,463,766 | 3/1949 | Hadley | 417/566 |
| 3,462,073 | 8/1969 | Russell | 417/566 |
| 3,635,598 | 1/1972 | Sieper | 417/471 X |
| 4,070,133 | 1/1978 | McCormick | 417/557 X |
| 4,295,414 | 10/1981 | Mochizuki et al. | 417/471 X |

*Primary Examiner*—Carlton R. Croyle
*Assistant Examiner*—Paul F. Neils
*Attorney, Agent, or Firm*—Oblon, Fisher, Spivak, McClelland & Maier

[57] ABSTRACT

A diaphragm-type vacuum pump device which includes a diaphragm, a pumping chamber the volume of which is changed by reciprocating motion of the diaphragm, a check valve for drawing air into the pumping chamber, a check valve for discharging air from the pumping chamber and an orifice or relief valve disposed in the pumping chamber so that the pumping chamber communicates with atmosphere.

5 Claims, 7 Drawing Sheets

DIAPHRAGM-TYPE VACUUM PUMP DEVICE

This application is a continuation of application Ser. No. 769,468, filed on Aug. 26, 1985, now abandoned.

BACKGROUND OF THE INVENTION

1. Field of the Invention

This invention relates to diaphragm-type vacuum pump devices for generating a required vacuum by a displacement of a diaphram operated by a motor and, more particularly, to diaphragm-type vacuum pump devices used in, for example, a vacuum-actuated speed control system or a vacuum-actuated brake booster in a motor vehicle, as a vacuum source to supply vacuum under a condition where insufficient engine vacuum is generated at an engine intake manifold.

2. Discussion of the Background

In a conventional diaphragm-type vacuum pump device such as shown in Japanese Utility Model Laid-open Application No. 50 (1975)-155610 or Japanese Utility model Publication No. 58(1983)-36867, the diaphragm-type vacuum pump device generates a required vacuum by reciprocating motion of a diaphragm when the vacuum at the engine intake manifold decreases and is less than a predetermined value.

Such diaphragm-type vacuum pump device uses, for example, a vacuum-type speed control system as shown in FIG. 3 in which the actual speed of the motor vehicle is controlled automatically and is automatically maintained at a set speed without depressing an accelerator pedal.

In the vacuum-type speed control system, an engine intake manifold 1 is connected to a chamber 10*a* of a vacuum pump via a pipe 2. As a result, a valve 11 is changed to an open condition by the vacuum existing in the engine intake manifold 1. Then the vacuum at the engine manifold 1 is communicated with an actuator 5 via the valve 11, a chamber 10*b* (communicable with the chamber 10*a* through the valve 11) and a pipe 4. The actuator 5 pulls an accelerator link by the force of the atmospheric pressure caused by the vacuum at the engine intake manifold 1. In order to pull an accelerator link by the actuator 5, the vacuum level at the engine intake manifold 1 is higher than a predetermined required level, (i.e., a mm Hg) as represented in FIG. 4. The actuator 5 is operated by a controller 6 and controls the degree of opening of a throttle valve 7.

When the vacuum at the engine intake manifold decreases and reaches the predetermined level, a vacuum responsive switch 8 operates and supplies a detecting signal to the controller 6. Then the controller 6 supplies a current to a motor 12 which drives the vacuum pump 10. The motor 12 operates to rotate a crank shaft of vacuum pump 10. A diaphragm 13 reciprocates vertically in response to the movement of the crank shaft. Therefore valves 14 and 15 are respectively alternately changed to opposite conditions. Thus the vacuum at the chamber 10*b* is increased.

The vacuum pump 10 is required to generate a vacuum higher than the determined pressure (a mm Hg) even when flow consumption is at a maximum value. Therefore, the vacuum pump having pumping characteristics as shown in FIG. 4 is used.

However, in the conventional diaphragm-type vacuum pump 10, when flow consumption in the actuator 5 is less, the generating vacuum in the vacuum pump 10 is increased as shown in FIG. 4. Furthermore, in starting the vacuum pump 10, a heavy load is applied to the motor 12. Therefore, a large starting torque in the motor 12 as a driving power source of the vacuum pump 10 is required. Consequently, in the conventional vacuum pump, the motor for driving the vacuum pump is required to be more powerful and must be more durable.

SUMMARY OF THE INVENTION

It is therefore an object of the present invention to avoid the disadvantages of the prior art diaphragm-type vacuum pump devices noted above.

More particularly, it is an object of the present invention to provide an improved diaphragm-type vacuum pump device which is operable with a smaller driving torque of the diaphragm during starting.

It is another object of the present invention to provide an improved diaphragm-type vacuum pump device which is prevented from generating an excessive vacuum.

These and other objects are achieved or facilitated in accordance with the present invention by providing a new and improved diaphragm-type vacuum pump which includes a diaphragm, a pumping chamber for operating a check valve for drawing air thereinto and a check valve for discharging air therefrom disposed therein by the change of volume thereof due to reciprocating motion of the diaphragm and an orifice disposed in the pumping chamber so as to communicate the pumping chamber with atmospheric pressure existing outside the pumping chamber.

Accordingly, the atmospheric pressure is introduced into the pumping chamber during starting whereby the starting torque of the vacuum pump can be decreased.

According to another aspect of the present invention, the diaphragm-type vacuum pump includes a diaphragm, a pumping chamber for operating a check valve for drawing air thereinto and a check valve for discharging air therefrom by the change of volume of the pumping chamber due to reciprocating motion of the diaphragm and a relief valve disposed in the pumping chamber so as to change the open condition thereof when the level of vacuum at the pumping chamber exceeds the predetermined value. Accordingly, when the level of vacuum at the pumping chamber exceeds the predetermined value due to the movement of diaphragm, the relief valve introduces atmospheric air into the pumping chamber, whereby an excessive vacuum condition in the pumping chamber can be prevented.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
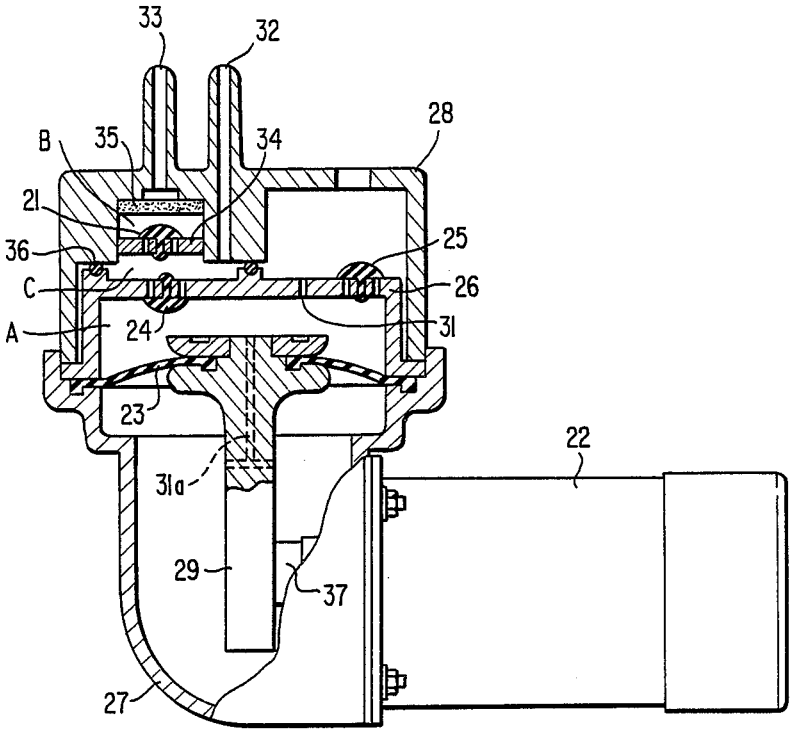
FIG. 1 is a partial sectional view of the first embodiment of a diaphragm-type vacuum pump device constructed in accordance with the present invention.

Referring now to the drawings, there is illustrated in FIG. 1 a diaphragm-type vacuum pump which includes a pumping chamber A formed between a diaphragm 23 of elastic material such as rubber, etc. and a second housing 26 disposed within a first housing 28. The entire outer circumferential portions of diaphragm 23 is clamped between the second housing 26 and a third housing 27. The clamping force on diaphragm 23 is obtained by tightening screws (not shown) of housings 28 and 27, but may be obtained by tightening screws of housings 28, 26 and 27 or by other fixing means.

A first end portion of a connecting rod 29 is fixed to the center portion of the diaphragm 23, and a second end portion of the connecting rod 29 is rotatably mounted on a crank shaft 37. The crank shaft 37 is connected to a rotational shaft (not shown) of a motor 22 and generates reciprocating vertical movement of the connecting rod 29.

Connection of the connecting rod 29 and the diaphragm 23 is accomplished not only by connection of one end portion of the connecting rod 29 with the diaphragm 23 but also by use of a connecting member which prevents damage to the diaphragm 23 caused by an oscillatory motion of the fixing portion between one end portion of the connecting rod 29 and the diaphragm 23. The motor 22 may be an electromagnetically operated reciprocating motor.

A check valve 24 for drawing air into the pumping chamber A and a check valve 25 for discharging air from the pumping chamber A are disposed in the second housing 26. An orifice 31 for communicating the pumping chamber A with atmospheric pressure and having a predetermined ventilation resistance is formed in the second housing 26 at the side of check valve 25.

An intake port 32 communicated with an actuator and an exhaust port 33 communicated with an engine intake manifold are disposed in the first housing 28. An exhaust check valve 21 is mounted on a valve supporting member 34 disposed between the intake port 32 and the exhaust port 33. An exhaust chamber B for introducing vacuum from the engine intake manifold via the exhaust port 33 is formed between the exhaust port 33 and the check valve 21. An intake chamber C for introducing vacuum to the actuator via the intake port 32 is located between valve supporting member 34 and second housing 26. An air filter 35 is disposed between the exhaust port 33 and the check valve 21. The vacuum generated at the engine intake manifold is introduced into the actuator via intake port 32, intake chamber C, check valve 21 for exhausting the exhaust chamber B, air filter 35 and exhaust port 33.

An O-ring 36 is disposed between first housing 28 and second housing 26 so as to maintain the intake chamber C airtight. The check valves 21, 24 and 25 are of an umbrella-type which are well known.

The operation of a diaphragm-type vacuum pump device as shown in FIG. 1 is as follows: the vacuum is introduced to the exhausting chamber B from the engine intake manifold via the exhaust port 33 serves to open the check valve 21 whereby the vacuum is introduced into the actuator via the check valve 21 and the intake port 32. In general, the vacuum at the engine intake manifold is directly introduced into the actuator and is used to control a throttle valve.

When the vacuum at the engine intake manifold is lessened, the motor 22 is operated, whereby the diaphragm 23 is reciprocated and the level of vacuum in the inhalant chamber C is then increased by operation of the pumping chamber A. For example, when the pumping chamber A is expanded, the check valve 24 assumes an open condition, air is sucked into the pumping chamber A via the check valve 24 and, therefore, the level of vacuum in the inhalant chamber C increases. In turn, when the pumping chamber A is contracted, the check valve 25 for discharging air assumes an open condition, whereby air within the pumping chamber A is discharged to atmosphere.

However, in the situation where the diaphragm-type vacuum pump is used in a speed control system of a motor vehicle, when a resumption switch is operated to return actual vehicle speed to the predetermined speed after braking operation during operation of the speed control system, a situation occurs whereby the level of the vacuum at the intake chamber C is high due to the flow consumption in the actuator being less. In such situation, the vacuum pump starts to operate, but the check valve 24 cannot assume an open condition until the level of vacuum in the pumping chamber A is changed so as to be higher than that of the intake chamber C and, therefore, the starting torque of the motor 22 is large.

Figure 2:
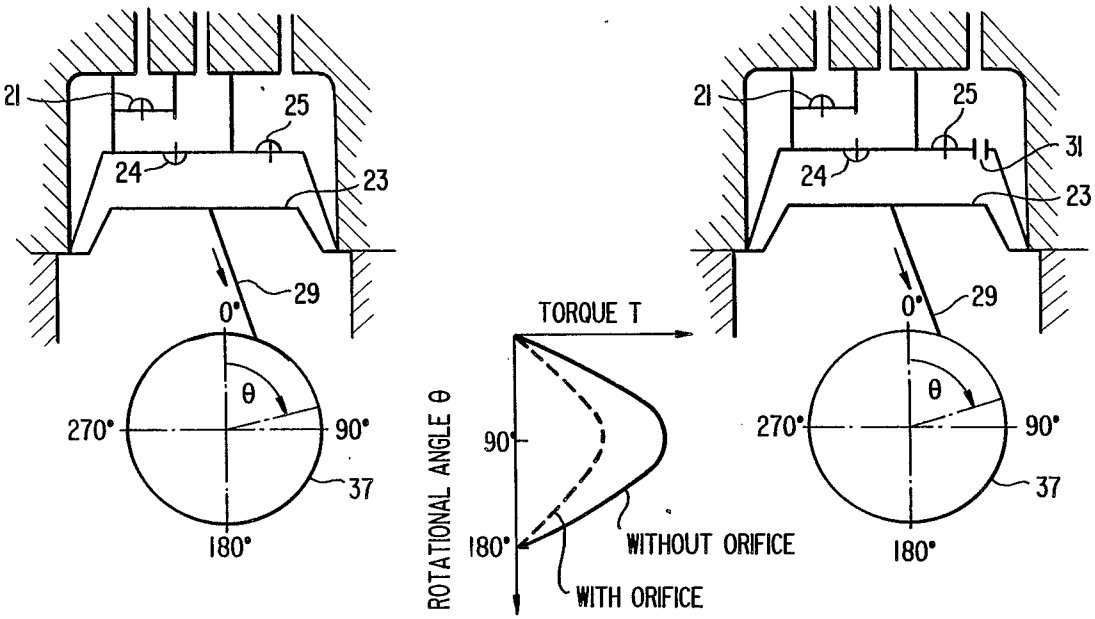
FIG. 2 is a schematic comparision of the structure and characteristics of a diaphragm-type vacuum pump according to the first embodiment of the present invention and a conventional-type pump.
Figure 3:
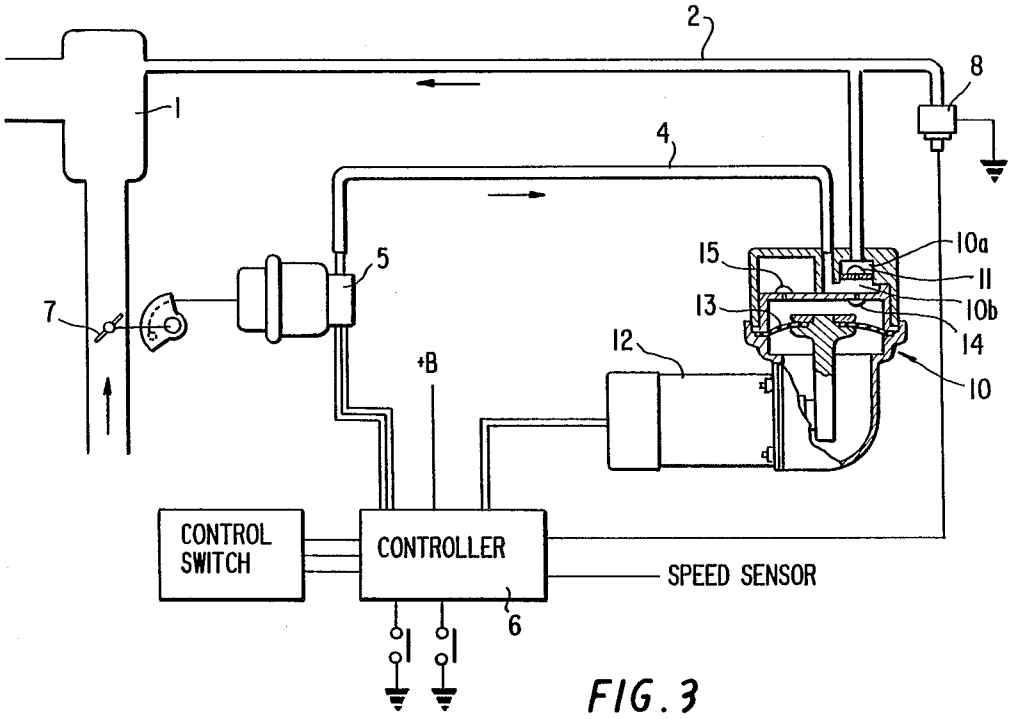
FIG. 3 shows an example of a diaphragm-type vacuum pump used in a vacuum actuated speed control system.
Figure 4:
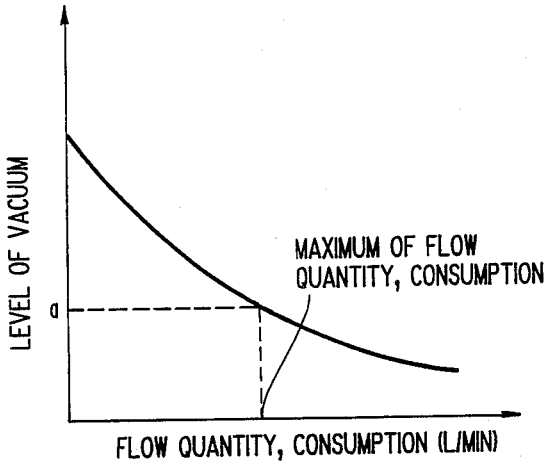
FIG. 4 shows the pumping characteristics of a diaphragm-type vacuum pump device.

On the other hand, when a rotational angle $\theta$ at the point of connection of the motor shaft 37 and the connecting rod 29 is 90°, the torque of the motor 22 is at its maximum as shown in FIG. 2.

The characteristics of a vacuum pump with the orifice 31 is shown by the broken line in the graph in FIG. 2, and the characteristics of a vacuum pump without the orifice 31 is shown by the solid line in the graph in FIG. 2. The torque of the vacuum pump with the orifice 31 is lower than that of the vacuum pump without the orifice 31 due to atmospheric pressure being continuously introduced into the pumping chamber A via the orifice 31, whereby the pressure at the pumping chamber A is maintained at or near atmospheric pressure during a stopping condition of the vacuum pump. Therefore, in the vacuum pump with the orifice 31, even if the motor 22 is started from the condition that the rotational angle $\theta$ is 90°, the starting torque of the motor 22 can be reduced.

In the first embodiment according to the present invention, although the orifice 31 is shown as being disposed in the second housing 26, the orifice 31 can be replaced by an orifice 31*a* disposed within the connecting rod 29 as shown in the broken line in FIG. 1 for communicating the pumping chamber A with atmospheric pressure.

Figure 11:
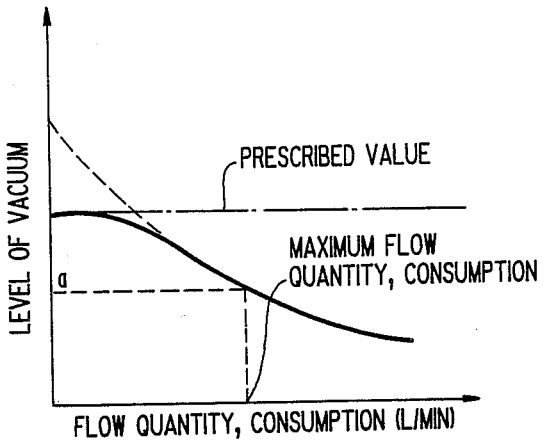
FIG. 11 shows the pumping characteristics of the second through fourth embodiments of the diaphragm-type vacuum pump constructed in accordance with the present invention.
Figure 5:
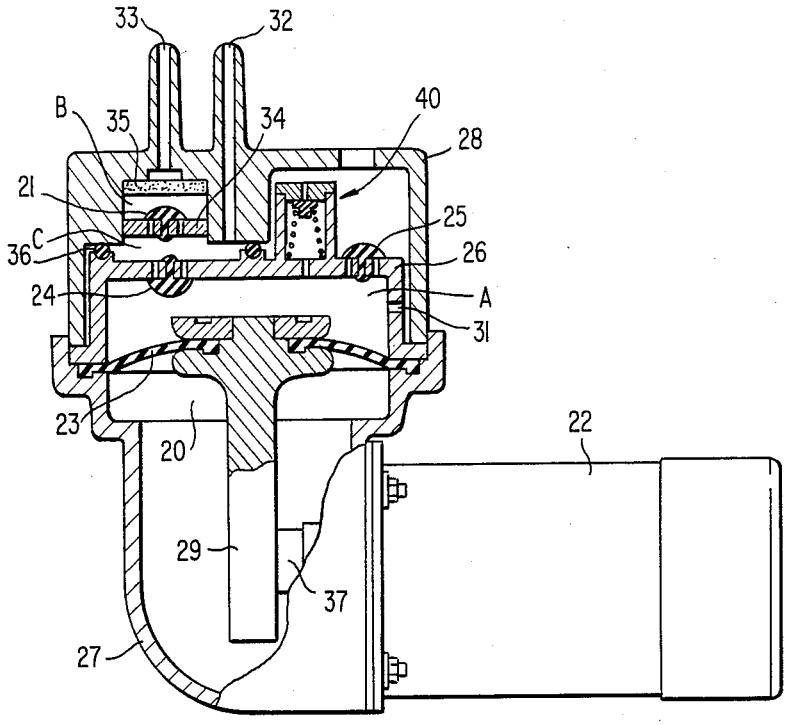
FIG. 5 is a partial sectional view of the second embodiment of a diaphragm-type vacuum pump device constructed in accordance with the present invention.
Figure 6:
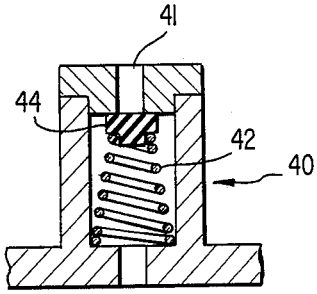
FIG. 6 is a partial enlarged sectional view of a relief valve according to the second embodiment in the present invention.

FIG. 5 and FIG. 6 show a second embodiment according to the present invention. In FIG. 5, the same reference numerals indicate the same members in accordance with the first embodiment of the present invention. Relief valve means 40 are disposed in the second housing 26. A valve member 44 is biased to a closed position by a spring 42 so as to contact a relief port 41. The relief port 41 communicates the pumping chamber A to atmosphere when the valve member 44 is opened and maintains the pressure within chamber A when the valve member is closed. When the level of vacuum within the pumping chamber A increases and reaches the prescribed value, the valve member 44 moves downwardly against the biasing force of spring 42, whereby atmospheric pressure is introduced into the pumping chamber A via the relief valve 40. Therefore, the level of the vacuum within the pumping chamber A does not exceed the prescribed value by the operation of the relief valve 40. As a result, the characteristics of the vacuum pump are as shown by the solid line in FIG. 11.

Figure 7:
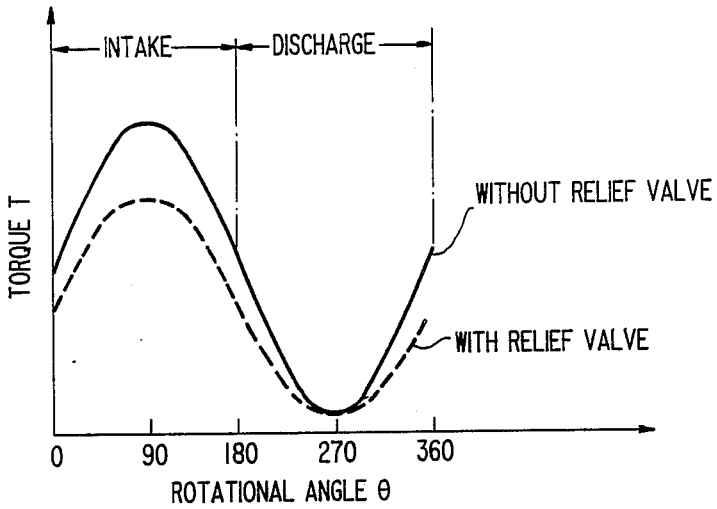
FIG. 7 shows the characteristics of the rotational angle and torque of a diaphragm-type vacuum pump.
Figure 8:
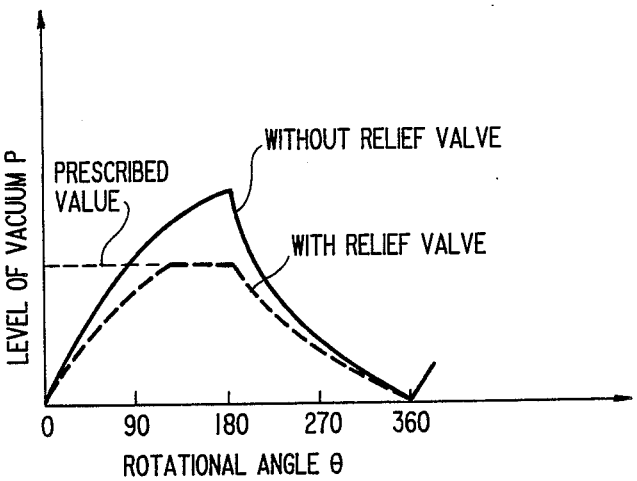
FIG. 8 shows the characteristics of the rotational angle and the level of vacuum in a diaphragm-type vacuum pump.

Furthermore, the relationship between the torque T of the motor 22 and the rotational angle $\theta$ of the connecting rod 29 and between the level P of the vacuum at the pumping chamber A and the rotational angle $\theta$ of the connecting rod 29 of the motor 22 are as shown in FIG. 7 and FIG. 8. The rotational angle $\theta$ in FIG. 7 and FIG. 8 are similar to the rotational angle $\theta$ as shown in FIG. 2.

As shown by broken lines in FIG. 7 and FIG. 8, the peaks of the torque T and the level P of the vacuum at the pumping chamber A of the vacuum pump in accordance with the second embodiment of the present invention are lower than that of the conventional vacuum pump which is not equipped with the relief valve 40. The torque T and the level P of the vacuum at the pumping chamber in the conventional vacuum pump are as shown in solid lines in FIG. 7 and FIG. 8.

Furthermore, in the second embodiment of the vacuum pump according to the present invention, the orifice 31 is also disposed in the second housing 26 as shown in FIG. 5. Therefore, the starting torque of motor 22 can be reduced in a manner similar to that of the first embodiment of the vacuum pump according to the present invention.

Figure 9:
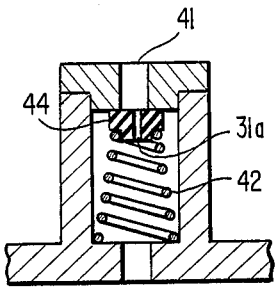
FIG. 9 is a partial enlarged sectional view of the third embodiment of a diaphragm-type vacuum pump constructed in accordance with the present invention.

FIG. 9 shows a third embodiment according to the present invention which is a modification of the second embodiment and in which an orifice 31*a* is similar to the orifice 31 as shown in FIG. 1 and FIG. 5 is disposed in the valve member 44 of the relief valve 40.

Figure 10:
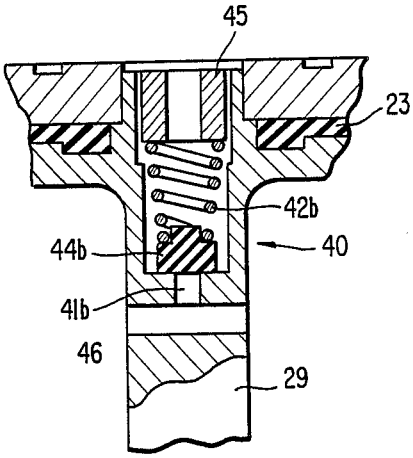
FIG. 10 is a partial enlarged sectional view of the fourth embodiment of a diaphragm-type vacuum pump constructed in accordance with the present invention.

FIG. 10 shows a fourth embodiment according to the present invention which is a modification of the second embodiment and in which the relief valve 40 is disposed in the connecting rod 29. Namely, a valve member 44*b* of the relief valve 40 is biased in a closing direction thereof by a spring 42*b*. A relief port 41*b* of the relief valve 40 is disposed in the connecting rod 29 and is communicated with atmospheric pressure via a hole 46 and the third housing 27. The biasing force of the spring 42*b* is adjustable by positioning an adjustable screw 45 which is movable in an axial direction with respect to and engageable with the connecting rod 29 as shown in FIG. 10.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A diaphragm-type vacuum pump device for generating a required vacuum, comprising:

a motor;

a first housing having a diaphragm mechanically positioned therein connected to and movable by said motor;

a second housing connected to said first housing and having an inlet port connected to an intake chamber;

a third housing positioned in said second housing and having a pumping chamber formed therein wherein a volume of said pumping chamber is changed by movement of said diaphragm;

a first check valve mounted on said third housing and in communication with said intake chamber for drawing air from said intake chamber into said pumping chamber in response to said movement of said diaphragm;

a second check valve mounted on said third housing for discharging air from said pumping chamber to atmosphere in response to said movement of said diaphragm; and orifice means formed in said third housing for continuously communicating said pumping chamber with atmosphere wherein said orifice means is in direct communication with said pumping chamber and has a constant predetermined opening area; and an exhaust check valve positioned within said second housing wherein said second housing includes an exhaust chamber formed therein for communication with an engine intake manifold and said intake chamber via said exhaust check valve so that vacuum of said engine intake manifold is communicated with said intake chamber.

2. A diaphragm-type vacuum pump device according to claim 1, wherein said intake chamber of said second housing includes an exhaust port and wherein said exhaust check valve is positioned between said third housing and said exhaust port.

3. A diaphragm-type vacuum pump device for generating a required vacuum, comprising:

a motor;

a first housing having a diaphragm mechanically positioned therein connected to and movable by said motor;

a second housing connected to said first housing and having an inlet port connected to an intake chamber;

a third housing positioned in said second housing and having a pumping chamber formed therein wherein a volume of said pumping chamber is changed by movement of said diaphragm;

a first check valve mounted on said third housing and in communication with said intake chamber for drawing air from said intake chamber into said pumping chamber in response to said movement of said diaphragm;

a second check valve mounted on said third housing for discharging air from said pumping chamber to atmosphere in response to said movement of said diaphragm;

relief valve means mounted on said third housing for communicating said pumping chamber with atmosphere when a pressure difference between a level of vacuum in said pumping chamber and atmospheric pressure reaches a predetermined value;

orifice means formed in said third housing for continuously communicating said pumping chamber with atmosphere, said orifice means being in direct communication with said pumping chamber and having a constant predetermined opening area; and an exhaust check value positioned within said second housing wherein said second housing includes an exhaust chamber formed therein for communication with an engine intake manifold and said intake chamber via said exhaust check valve so that vacuum of said engine intake manifold is communicated with said intake chamber.

4. A diaphragm-type vacuum pump device according to claim 3, wherein said relief valve means is disposed within said third housing.

5. A diaphragm-type vacuum pump device according to claim 3, wherein said intake chamber of said second housing includes an exhaust port and wherein said exhaust check valve is positioned between said third housing and said exhaust port.

* * * * *